US005782027A

United States Patent [19]

Gildea

[11] Patent Number: 5,782,027

[45] Date of Patent: Jul. 21, 1998

[54] DEVICE FOR CONVERTING A POLE INTO A SIMULATIVE ADVERTISING DISPLAY

[76] Inventor: Sean T. Gildea, 58 Harbor Ave., Marblehead, Mass. 01945

[21] Appl. No.: 820,366

[22] Filed: Mar. 12, 1997

[51] Int. Cl.[6] ..... G09F 5/08

[52] U.S. Cl. ..... 40/538; 40/607; 52/736.4

[58] Field of Search ..... 40/538, 607, 624; 446/366; 405/216; 52/736.3, 736.4

[56] References Cited

U.S. PATENT DOCUMENTS

| | | | |
|---|---|---|---|
| 2,870,558 | 1/1959 | Fuller . | |
| 2,899,765 | 8/1959 | Fuller . | |
| 3,104,875 | 9/1963 | Doyle . | |
| 3,928,930 | 12/1975 | Attwood . | |
| 3,947,985 | 4/1976 | Skrzypczak . | |
| 4,244,156 | 1/1981 | Watts, Jr. . | |
| 4,454,671 | 6/1984 | Morgenstern | 40/607 |
| 5,116,204 | 5/1992 | Power et al. | 40/607 |
| 5,561,930 | 10/1996 | Ashley et al. . | |
| 5,605,414 | 2/1997 | Fuller et al. | 40/607 X |

FOREIGN PATENT DOCUMENTS

| | | | |
|---|---|---|---|
| 11733 | 4/1910 | France | 40/538 |
| 9302 | 4/1902 | United Kingdom | 40/538 |
| 363853 | 12/1931 | United Kingdom | 40/538 |

*Primary Examiner*—Blair Johnson
*Attorney, Agent, or Firm*—O'Connell Law Firm

[57] ABSTRACT

A device for converting a pole into a simulative advertising display comprised of a first body element and, possibly, a second body element each for simulating in a magnified proportion at least a portion of a product to be advertised, a pole engaging surface, and a mechanism for coupling the body element or elements with a pole. Where the device simulates a bottle, there may be a strap simulating a bottle cap for surrounding a neck of the simulated bottle and coupling the device to a pole, and there may be a removable sheet label for surrounding a base of the simulated bottle for coupling the device to a pole and permitting a substitution of an advertised message by a replacement of the sheet label. The body element or elements may be comprised of a shell constructed with an impact absorbing material coated with a protective surface coating.

9 Claims, 5 Drawing Sheets

DEVICE FOR CONVERTING A POLE INTO A SIMULATIVE ADVERTISING DISPLAY

FIELD OF THE INVENTION

The present invention relates generally to devices for advertising products. More particularly, this specification and the accompanying drawings disclose a device for converting a pole into a simulative advertising display.

BACKGROUND OF THE INVENTION

For time immemorial, signs of metal, wood, and plastic have been employed to depict advertiser's products and services. Consequently, advertising displays, even those simulating the advertised product or service in two and even three dimensions, are known to the prior art. The need for effective advertising has resulted in signs being situated at nearly every conceivable location both indoors and out.

Nonetheless, one available advertising location appears not to have been put to its full use. One will realize that poles may be found in nearly any environment. There are support poles in buildings, utility poles lining streets, and poles on ski mountains for supporting ski lifts. One important point that the shear multiplicity of poles raises relative to the instant invention is that a tremendous amount of unique advertising space as of yet has been left underused. Thus far, advertising on poles has been limited substantially to the posting of sheets of paper and the like with tape or tacks. One may note also that poles are not always aesthetically pleasing. Still further, one may realize that poles can present dangerous obstacles to those attempting to maneuver around them. The danger presented by poles is particularly acute on ski mountains where the towering metal lift poles often loom dangerously in the paths of skiers and snowboarders and on streets where thick utility poles line the street's edge.

With these things in mind, there appears to be a need left by the prior art for an advertising device that effectively converts a pole into a simulative advertising display thereby making effective use of otherwise underused advertising space, improving the appearance of the pole, and, potentially, serving as a protective barrier around at least part of the pole.

SUMMARY OF THE INVENTION

Advantageously, the present disclosure is directed to a device for converting a pole into a simulative advertising display. Although a number of objects and advantages of the invention will become obvious to one who reads this specification and reviews the accompanying drawings, a few are worth particular mention. For example, a principal object of the present invention is to provide an advertising display that makes optimal use of poles as an advertising medium. An incidental object of the invention is to improve the appearance of poles and their surrounding environment. A further object of the invention is to provide a protective shield, possibly substantially surrounding a pole to which it is coupled, for improving the safety of persons relative to the pole and for reducing damage to the pole due to collisions.

In accomplishing these objects, the invention is comprised essentially of a first body element for simulating in a magnified proportion at least a portion of a product to be advertised and a means for coupling the first body element with a pole. The first body element has an outer surface simulating at least a section of a product to be advertised and a pole engaging surface with a means for engaging a pole.

When the first body element is attached to a pole, it shields the pole thereby causing at least a portion of the pole to simulate a product to be advertised.

The first body element may simulate substantially an entire product, and the pole engaging surface may be a central opening in the first body element. The first body element may have a longitudinal slot in it for receiving a pole that is defined by a first longitudinal edge and a second longitudinal edge, and the first body element may be resilient so that the slot may be opened by pulling the longitudinal edges apart to allow the pole to be received into the central opening.

Although one body element may accomplish many if not all of the objectives of this invention, it may be most advantageous to supplement the first body element with a second body element, with each body element simulating about one-half of a vertically sectioned product so that, together, they substantially surround a pole and simulate substantially an entire product. In any event, the body element or elements may simulate many different products such as, for example, a beverage container such as a bottle or a can. A bottle may have a simulated bottle neck, a simulated bottle base, and first and second pole engaging lips on the pole engaging surfaces of the bottle neck and bottle base respectively.

The beverage bottle theme may be supplemented further by the coupling means' including a strap simulating a circumferential edge of a bottle cap designed to surround both the bottle neck and the pole thereby tending to hold the two in a coupled relationship while giving the appearance of a bottle cap. Still further, the body element or elements may be surrounded by a removable sheet label which would perform the dual function of better coupling the body element or elements with a pole and of conveying an easily removable advertising message.

Where the application permits, it is contemplated that the device should have a height greatly magnifying that of the product to be advertised. Where appropriate, the body elements should be of a height sufficient to cover most of a pole to which it is coupled. For example, when the invention is to be used with the posts of a ski mountain ski lift, the body elements should be greater than about ten feet in height. More preferably, the device would be greater than about twenty feet tall so that nearly the entire pole is concealed and effectively converted into an advertising display.

Where the application suggests the need for protection from collisions, as on a ski mountain, it may be particularly useful to construct the device to absorb the energy of a collision. To do so, the device may be filled with an energy absorbing material such as sand, foam, or the like. Alternatively or additionally, the thickness of the shell may be comprised of a layer of an energy absorbing material coated with a protective surface coating in a manner analogous to bicycle helmets and the like.

The invention may be used to convert a series of poles into related advertising displays. For example, a series of poles on a ski lift could be converted into related advertising displays so that a given lift could assume the name of the advertised product. By way of example, there could be a "White Mountain Soda" lift with at least some of the lift poles of the lift simulating bottles or cans of "White Mountain Soda." The theme could be supplemented by a table on the ski mountain simulating a greatly enlarged, upside-down bottle cap. The cap could retain further advertising, or maps, or other materials.

The foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION

Figure 1:
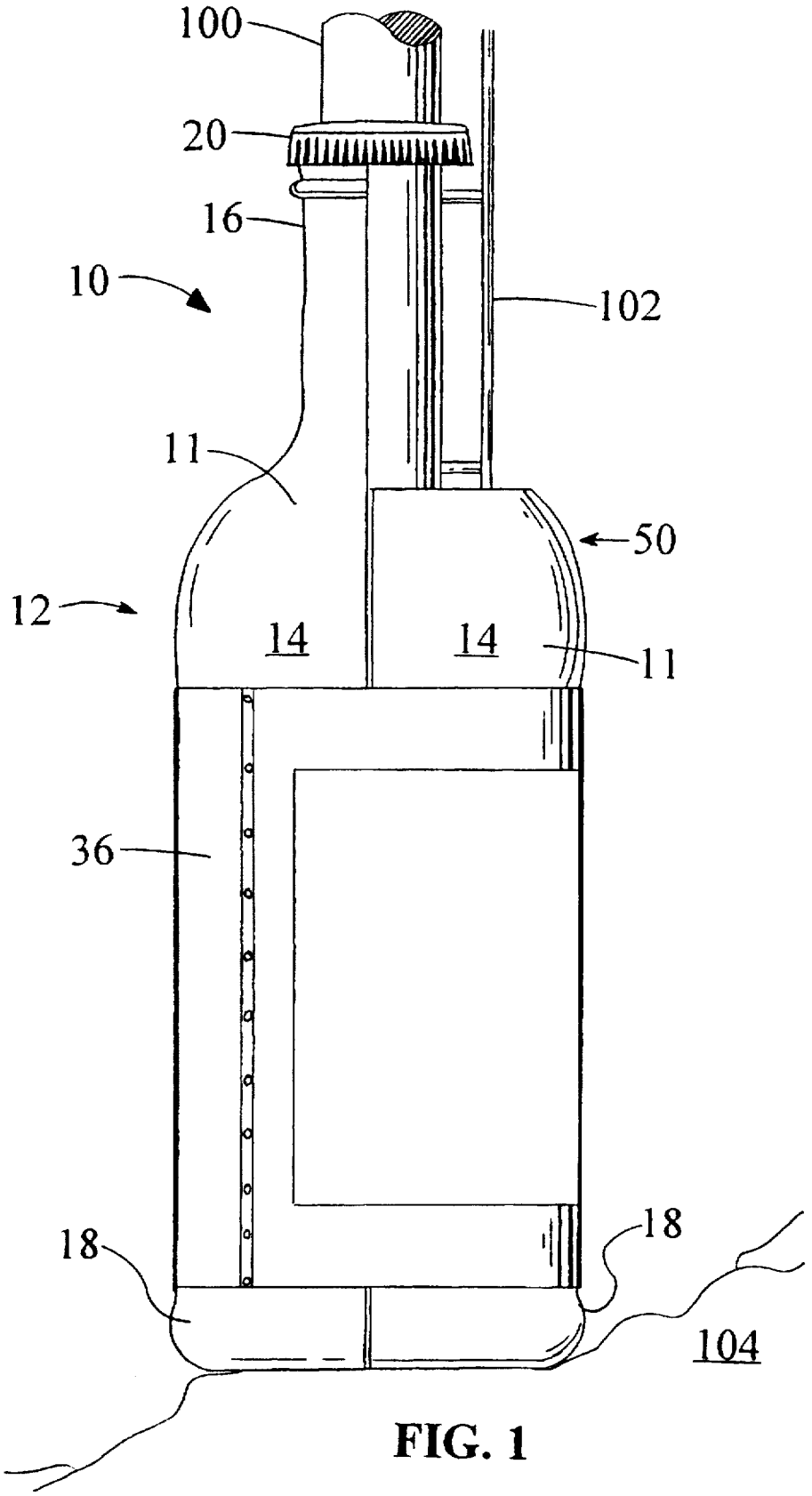
FIG. 1 is a view in side elevation of a device according to the present invention shown on a ski mountain coupled with a lift pole.

Referring more particularly to FIG. 1, the figure shows a device according to the present invention generally indicated at 10. The device 10 for converting a pole into a simulative advertising display is shown coupled to a ski lift pole 100 on a typical ski mountain slope 104. Also, in this embodiment, the device 10 is shown simulating a beverage bottle. However, the device 10 may be adapted for coupling with any desired pole, and many other products and containers may be simulated in addition to a beverage bottle.

Figure 2:
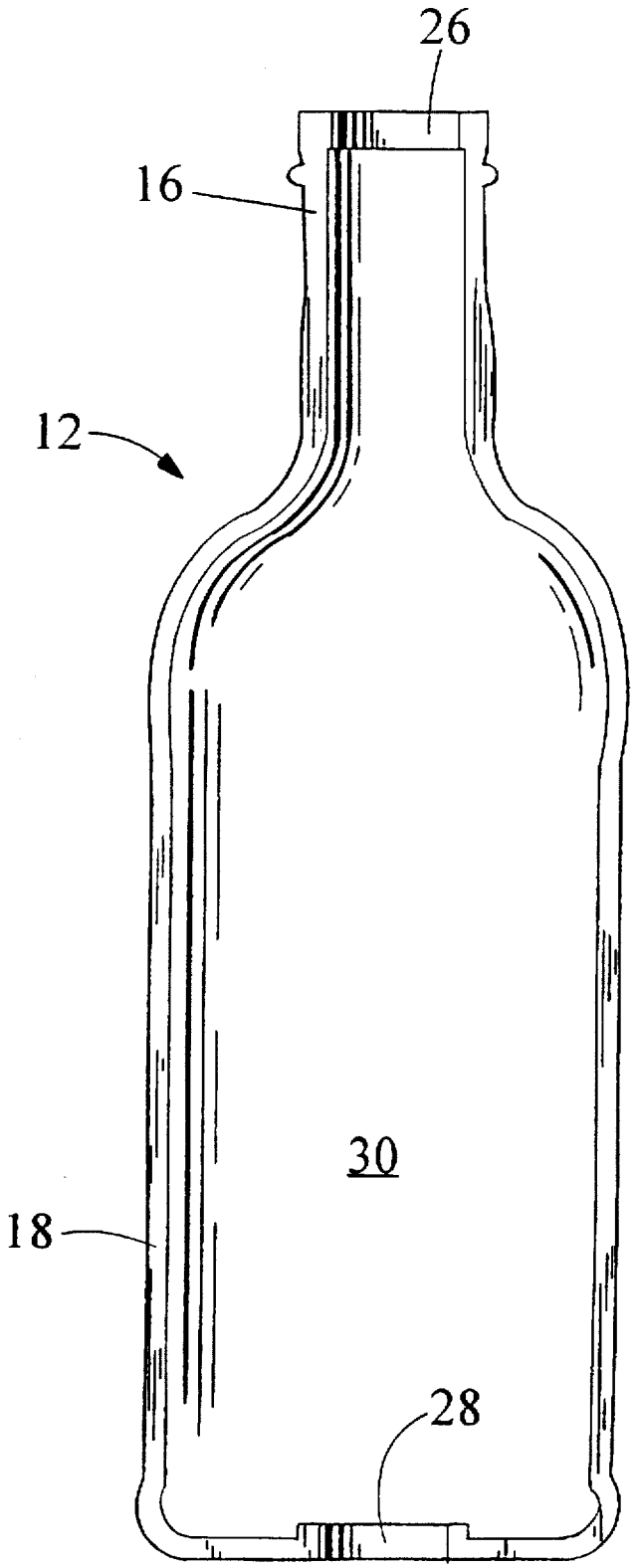
FIG. 2 is a view in rear elevation of a first body element according to the present invention.

In the embodiment of FIG. 1, the device 10 is comprised of a first body element 12 and a second body element 50 with each of the body elements 12 and 50 simulating roughly one-half of a beverage bottle. The first body element 12 and the second body element 50 each has a shell 11, a front surface 14, and a base 18. The first body element 12 has a simulated bottle neck 16 while the second body element 50 lacks a complete neck to provide clearance for a ladder 102 of the type commonly traveling up ski lift poles such at that shown at 100. Each shell 11 is generally hollow and has a given thickness. Referring to FIG. 2, one sees a view in rear elevation of the first body element 12. The figure shows that the first body element 12 has a pole engaging surface 30, a first pole engaging lip 26, and a second pole engaging lip 28.

As FIG. 1 shows, there is a strap 20 that simulates a circumferential edge of a bottle cap surrounding the pole 100 and the neck 16 of the first body element 12 to couple the two together. Preferably, the strap 20 is of a resilient material and, additionally or alternatively, is adjustable in length to couple the first body element 12 with the pole 100 in a secure relationship. One may note that coupling means in addition to the strap 20 may be necessary, and one may note further that, although in practice the device 10 may have product advertisement material printed directly thereon, it may be most desirable to have the material removably affixed to the device 10. A number of means could be employed to accomplish one or both purposes. For example, a removable sheet label 36 simulating in magnified proportion a label of a product to be advertised may surround the bottle base 15 to couple the device 10 to the pole 100 in a more secure manner while also providing a convenient means of quickly modifying the advertised product or message. Naturally, the sheet label 36 would be equally useful with a device 10 that has a single body element 12. The sheet label 36 is generally rectangular may be made of any suitable plexible material such as plastic or cloth.

Figure 3:
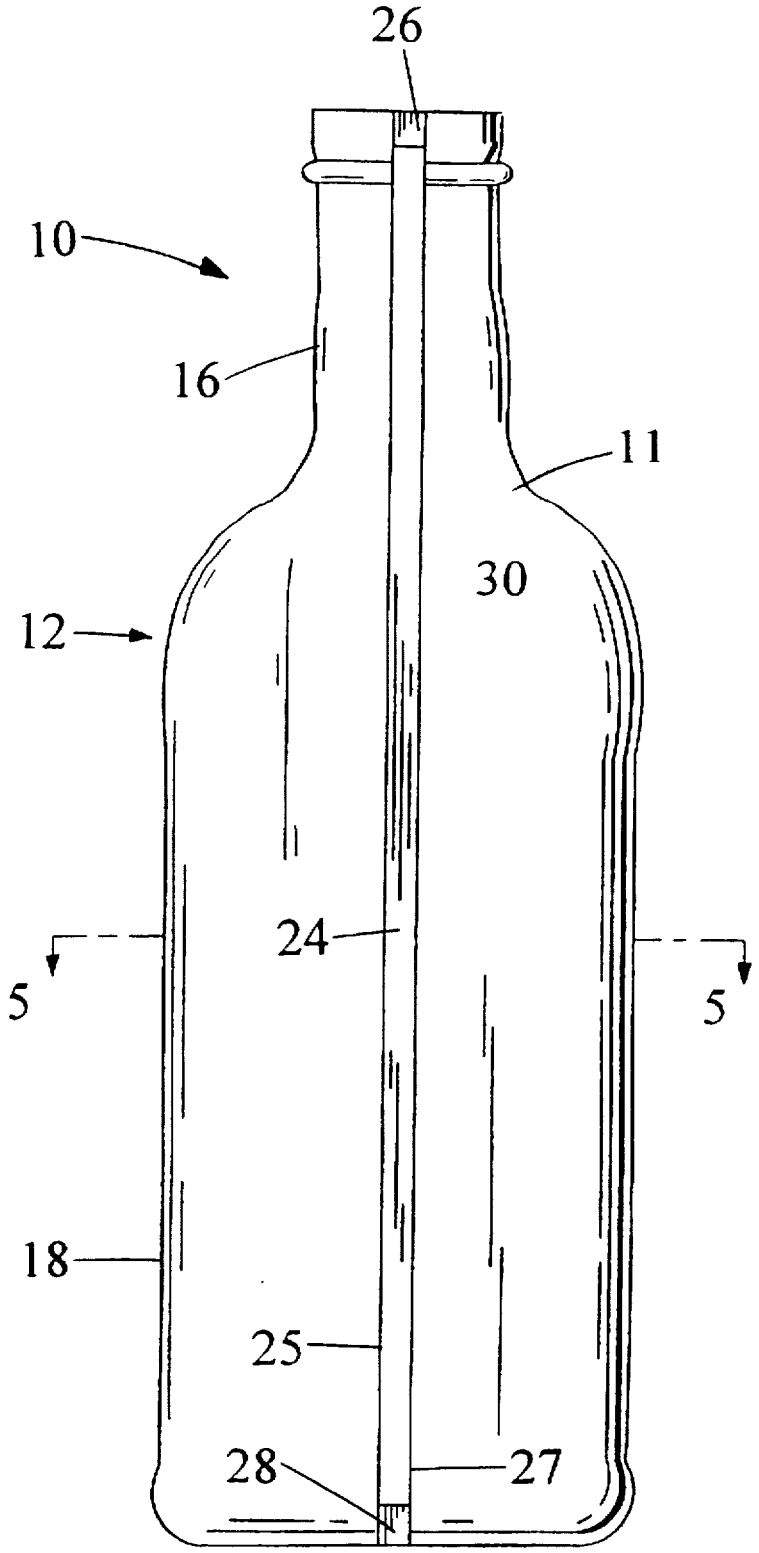
FIG. 3 is a view in side elevation of an alternative embodiment of the present invention.
Figure 4:
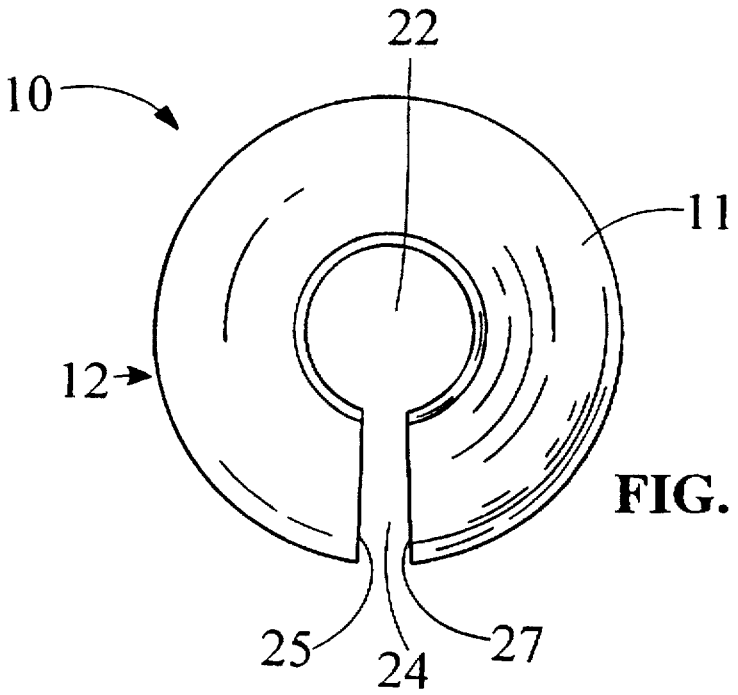
FIG. 4 is a top plan view of the device of FIG. 3.

FIGS. 3 and 4 show an alternative embodiment of the invention wherein the first body element 12 is unitary and simulates in magnified proportion substantially an entire bottle to be advertised. In this embodiment, the pole engaging surface 30 of the first body element 12 is defined by a central opening 22. To permit the first body element 12 to be coupled with a pole 100 in a substantially surrounding relationship, the shell 11 of the first body element 12 has a slot 24 for receiving the pole 100. The slot 24 is more narrow than an effective width of the central opening 22 is defined by a first longitudinal edge 25 and a second longitudinal edge 27. The shell 11 of the first body element 12 may be resilient whereby the first longitudinal edge 25 may be pressed away from the second longitudinal edge 27 to permit the pole 100 to be received more easily through the slot 24 into the central opening 22 and whereby the slot 24 narrows around a pole 100 that has been passed into the central opening 22. Although FIGS. 3 and 4 show the first body element 12 with a substantially complete neck 16, where the application requires, the neck 16 may be sectioned where necessary such as to permit the communication of a ladder such as that shown at 102 in FIG. 1. The strap 20 and the sheet label 36 again may be employed to couple the device 10 with a pole 100.

Figure 6:
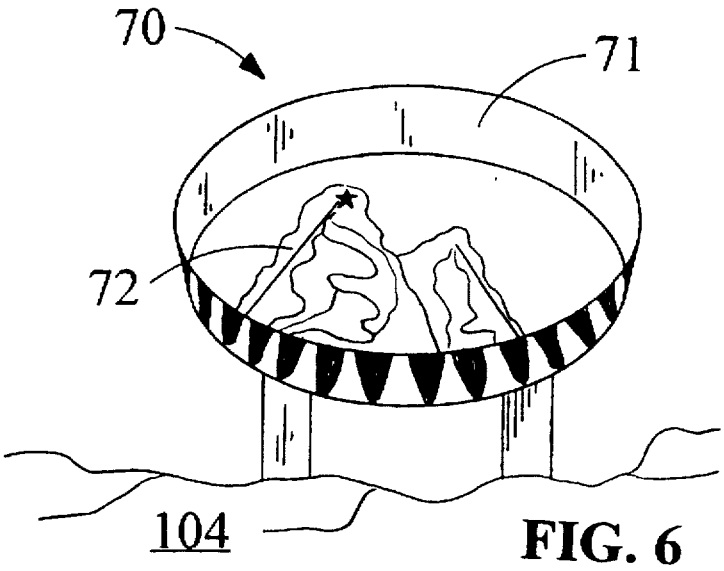
FIG. 6 is a perspective view of a bottle-cap table.

As was discussed above, it is contemplated that the invention may be used to convert a series of poles into related advertising displays. Again, a series of poles on a ski lift might be converted to related advertising displays so that a given lift could assume the name of the advertised product. For example, there could be a "White Mountain Soda" lift with a number of poles on the lift converted to giant "White Mountain Soda" bottles. As is shown by FIG. 6, the theme could be supplemented by a table 70 located somewhere on the ski mountain simulating a greatly enlarged upside-down bottle cap 71. The cap 71 could retain maps, additional advertising, or other materials 72.

Figure 5:
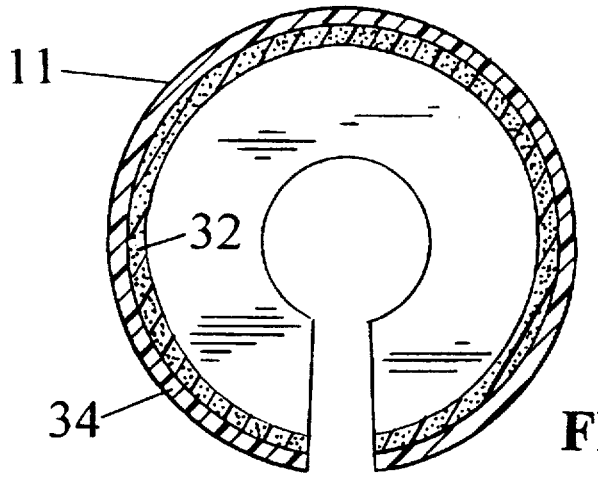
FIG. 5 is a partial sectional view of a shell according to a preferred embodiment of the present invention taken along the line 5—5 in FIG. 3.

As is noted above, a number of applications would make it desirable for the device 10 to provide some degree of collision protection or cushioning. This need might appear most prevalent on a ski mountain where the dangers of colliding with a ski lift pole are very real. As a result, in a preferred embodiment of the invention, the device 10 is constructed to act as a giant collision barrier. This could be done by filling the shell 11 with an energy absorbing material such as a particulate such as sand or foam. Additionally or alternatively, the shell 11 may be designed to absorb the energy of an impact. Looking to FIG. 5, a cross section taken along the line 5—5 in FIG. 3, one sees that the shell 11 has a thickness comprised of a layer of energy absorbing material 32 coated with a protective surface coating 34 in ways known to the art. In this preferred embodiment, the energy absorbing material 32 is a plastic foam and the protective surface coating 34 is plastic. Materials which are useful for producing the protective surface coating 34 include plastics which are adaptable for stretch-blow molding and which have good shock absorption characteristics. Such materials include polyethylene (PE), high density polyethylene (HDPE), polyethylene terephthalate (PET), polypropylene (PP), polyvinyl chloride (PVC), polyacrylonitrile (PAN), polycarbonates (PC), and acrylonitrile butadiene styrene (ABS).

From the foregoing, it is apparent that the present invention possesses a number of advantages over the prior art. For example, by its ability to convert a pole 100 into a simulative advertising display, the invention enables the optimal use of poles 100 as advertising mediums while permitting the rapid conversion of the displayed message by an exchange of one sheet label 36 for another. Furthermore, the invention improves the appearance of a pole 100 to which it is coupled and of the environment that surrounds it. Also, where the device 10 is designed for impact absorption, the invention increases the safety of those maneuvering around a given pole 100 while reducing damage to the pole 100 resulting from collisions. Taken together, the advances revealed by the present invention markedly increase available advertising space while improving the safety of the consuming public.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as protected by United States Letters Patent:

1. A device for converting a pole into a simulative advertising display, the device comprising:

a first body element for simulating in a magnified proportion at least a portion of a product to be advertised, the first body element with an outer surface simulating at least a section of a product to be advertised and with a pole engaging surface with a means for engaging a pole; and a means for coupling the first body element with a pole comprising a removable sheet label for conveying an advertising message and for surrounding the first body element and a pole to thereby couple the first body element with a pole wherein the removable sheet label comprises a generally rectangular sheet of flexible material and wherein the removable sheet label simulates in magnified proportion a label of a product to be advertised;

whereby the first body element, when attached to a pole, causes at least a portion of the pole to simulate a product to be advertised.

2. The device for converting a pole into a simulative advertising display, the device comprising:

a first body element for simulating in a magnified proportion at least a portion of a product to be advertised, the first body element with an outer surface simulating at least a section of a product to be advertised and with a pole engaging surface with a means for engaging a pole wherein the front surface of the first body element simulates in a magnified proportion at least approximately one-half of a vertically-sectioned bottle with a simulated bottle neck and a simulated bottle base; and a means for coupling the first body element with a pole comprising a strap simulating at least a circumferential edge of a bottle cap, the strap for surrounding the simulated bottle neck and a pole to which the device is to be coupled thereby coupling the device to a pole;

whereby the first body element, when attached to a pole, causes at least a portion of the pole to simulate a product to be advertised.

3. The device of claim 2 wherein the first body element has a height greater than about ten feet.

4. A device for converting a pole into a simulative advertising display, the device comprising:

a first body element for simulating in a magnified proportion approximately one-half of a vertically-sectioned product to be advertised;

a second body element for simulating in a magnified proportion approximately one-half of a vertically-sectioned product to be advertised;

the first body element and the second body element each with an outer surface simulating at least a section of a product to be advertised and a pole engaging surface with a means for engaging a pole; and a means for coupling the first body element to the second body element and to a vertically upstanding pole in a substantially surrounding relationship comprising a removable sheet label for conveying an advertising message and for surrounding the first body element, the second body element, and a pole thereby to couple the first body element, the second body element, and a pole wherein the removable sheet label comprises a generally rectangular sheet of flexible material and wherein the removable sheet label simulates in magnified proportion a label of a product to be advertised;

whereby the first body element and the second body element, when coupled to a pole, together substantially surround the pole to cause at least a portion of the pole to simulate a product to be advertised.

5. The device of claim 4 wherein the outer surface of the first body element and the outer surface of the second body element each simulate approximately one-half of a beverage container whereby the first body element and the second body element, when attached to a pole, together surround the pole to cause at least a portion of the pole to simulate a beverage container in magnified proportion.

6. A device for converting a pole into a simulative advertising display, the device comprising:

a first body element for simulating in a magnified proportion approximately one-half of a vertically-sectioned product to be advertised;

a second body element for simulating in a magnified proportion approximately one-half of a vertically-sectioned product to be advertised;

the first body element and the second body element each with an outer surface simulating at least a section of a product to be advertised and a pole engaging surface with a means for engaging a pole wherein the front surfaces of the first body element and the second body element each simulate approximately one-half of a bottle, the first body element with at least a portion of a simulated bottle neck and the first body element and the second body element each with a simulated bottle base; and a means for coupling the first body element to the second body element and to a vertically upstanding pole in a substantially surrounding relationship;

whereby the first body element and the second body element, when coupled to a pole, together substantially surround the pole to cause at least a portion of the pole to simulate a product to be advertised.

7. The device of claim 6 wherein the first body element and the second body element each have a height greater than about ten feet.

8. The device of claim 6 wherein the coupling means is comprised of a strap simulating at least a circumferential edge of a bottle cap for surrounding a pole to which the device is to be coupled and overlying an upper edge of the simulated bottle neck.

9. A device for converting a pole into a simulative advertising display, the device comprising:

a first body element for simulating in a magnified proportion approximately one-half of a vertically-sectioned product to be advertised;

a second body element for simulating in a magnified proportion approximately one-half of a vertically-sectioned product to be advertised;

the first body element and the second body element each with an outer surface simulating at least a section of a product to be advertised and a pole engaging surface with a means for engaging a pole; and a means for coupling the first body element to the second body element and to a vertically upstanding pole in a substantially surrounding relationship;

wherein the first body element and the second body element each are comprised of a generally hollow shell with a given thickness comprised of a layer of an energy absorbing material comprising a plastic foam coated with a protective surface coating chosen from the group consisting of polyethylene (PE), high density polyethylene (HDPE), polyethylene terephthalate (PET), polypropylene (PP), polyvinyl chloride (PVC), polyacrylonitrile (PAN), polycarbonates (PC), and acrylonitrile butadiene styrene (ABS) whereby the first body element and the second body element each comprise a protective, resilient shell and whereby the device mutually protects colliding objects, persons, and the pole from a collision with the pole whereby the first body element and the second body element, when coupled to a pole, together substantially surround the pole to cause at least a portion of the pole to simulate a product to be advertised.

* * * * *